United States Patent [19]

Morita et al.

[11] Patent Number: 4,494,371

[45] Date of Patent: Jan. 22, 1985

[54] METHOD AND APPARATUS FOR YARN PIECING IN A RINGLESS SPINNING MACHINE

[75] Inventors: Takayuki Morita, Kariya; Takahiko Tsunekawa; Hisao Amano, both of Aichi, all of Japan

[73] Assignee: Kabushiki Kaisha Toyoda Jidoshokki Seisakusho, Kariya, Japan

[21] Appl. No.: 521,601

[22] Filed: Aug. 9, 1983

[30] Foreign Application Priority Data

Aug. 12, 1982 [JP] Japan ..... 57-140161

[51] Int. Cl.[3] ..... D01H 15/00

[52] U.S. Cl. ..... 57/263

[58] Field of Search ..... 57/261, 263

[56] References Cited

U.S. PATENT DOCUMENTS

| | | | |
|---|---|---|---|
| 3,821,878 | 7/1974 | Parsons | 57/263 |
| 3,962,855 | 6/1976 | Stahlecker | 57/263 |
| 3,999,862 | 12/1976 | Schulz et al. | 57/263 |
| 4,107,957 | 8/1978 | Stahlecker et al. | 57/263 |
| 4,120,140 | 10/1978 | Raasch et al. | 57/263 |
| 4,132,056 | 1/1979 | Hüsges et al. | 57/263 |
| 4,163,358 | 8/1979 | Takeuchi et al. | 57/263 X |

*Primary Examiner*—Donald Watkins

*Attorney, Agent, or Firm*—Brooks Haidt Haffner & Delahunty

[57] ABSTRACT

Method and apparatus for yarn piecing in a ringless spinning machine is provided, according to which yarn piecing is accomplished by unwinding a yarn from its package, rewinding a portion of the unwound yarn on to the package at one, definite position, cutting off the yarn end to a predetermined length, then introducing the cut end of the yarn into the spinning mechanism of the spinning unit, and then withdrawing the yarn from the spinning unit after the yarn end is connected with the fibers in the spinning mechanism.

11 Claims, 16 Drawing Figures

METHOD AND APPARATUS FOR YARN PIECING IN A RINGLESS SPINNING MACHINE

FIELD OF THE INVENTION

The present invention relates to a method and apparatus for yarn piecing in a ringless spinning machine. More specifically, it relates to a technique for piecing a yarn which achieves a higher standard of uniformity and reliability than has heretofore been achieved in a pneumatically-operated ringless spinning machine.

BACKGROUND OF THE INVENTION

In a conventional method of yarn-piecing in a pneumatically-operated ringless spinning machine, e.g. an open-end spinning frame having a plurality of spinning units therealong and a travelling yarn piecing machine or unit, a roller is provided in the yarn piecing unit which is engageable with the package of yarn and is rotatable in both directions to wind and unwind the yarn on and from the package in the yarn piecing-up operation. In the event of a yarn break at any of the spinning stations, the roller is rotated first in its reverse direction for unwinding the yarn from the package to and inserting the free end of the broken whereupon the reversible roller is driven in its forward yarn back into the spinning mechanism of the spinning unit, direction to withdraw the pieced-up and spun yarn, to again wind the same on the package. In this method of yarn-piecing, accuracy in determining the unwound length of such yarn greatly influences the success or not of the yarn piecing and, therefore, the quality of the pieced-up yarn.

In such known methods, determination of the exact length of the yarn being unwound from a cone-shaped package by the reversible roller is particularly difficult because the length varies depending on the location on the package from which the yarn is unwound; namely, the length of yarn which is unwound from the small-end of the cone-shaped package is considerably different from that of yarn which is unreeled from the opposite, large-end of the cone. Even when unwinding yarn from a cylindrical-shaped package, the accuracy in determining the unwound length of the yarn is readily affected by the traversing motion of the yarn across the yarn package during the unwinding from the package, on which the yarn is traversely wound up.

Thus, the known conventional method of yarn-piecing in ringless spinning machines has a drawback or disadvantage in that the length of yarn unwound from its package is inaccurate and, therefore, the rate at which yarn-piecing service is accomplished successfully is affected by the inaccuracy.

SUMMARY OF THE INVENTION

Therefore, it is an object of the present invention to remove the above disadvantage by providing a method and apparatus for yarn-piecing in pneumatically-operated ringless spinning machines, by the use of which the rate of success of the piecing operation is greatly improved.

This object is attained by providing a method of yarn-piecing, which comprises the steps of unwinding a broken yarn end from the package by rotating the package in reverse direction, rewinding a part of the unwound yarn on the package at a given, or single location thereon by rotating the package in its forward direction, cutting the yarn end, inserting the cut yarn end into the spinning mechanism to a predetermined length by again reversing the rotation of the package, and then withdrawing the yarn after the cut yarn end introduced into the spinning mechanism has been connected to the fibers therein. Novel apparatus for withdrawing the broken yarn from the package and rewinding it at a single location on the package, and for subsequently cutting the yarn to proper length, are further features of the invention.

The above and other objects, features and advantages of the present invention will become more apparent to those skilled in the art from the following detailed description of preferred embodiments of the invention, when taken in conjunction with the accompanying drawings, wherein:

DETAILED DESCRIPTION OF PREFERRED EMBODIMENTS

The following will describe a preferred embodiment of a yarn piecing method and apparatus according to the invention which is applied specifically to an open-end spinning machine.

Figure 1:
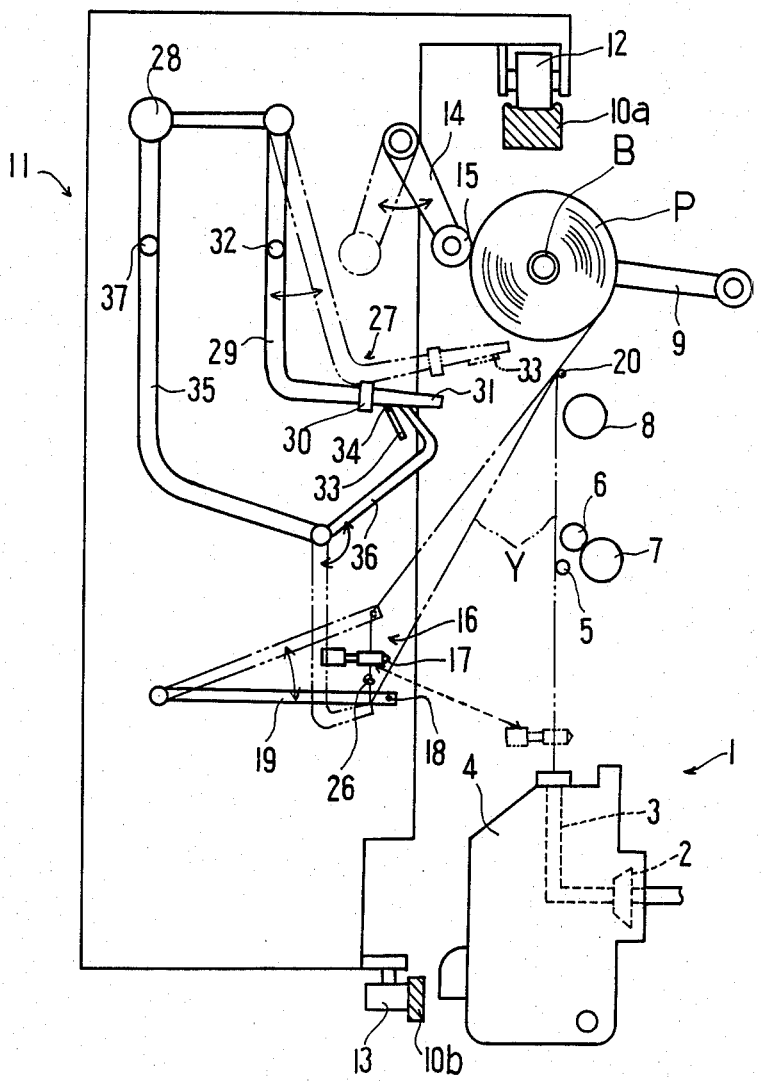
FIG. 1 is a side view of an arrangement of a spinning unit and a yarn piecing unit, in which one embodiment of the yarn-piecing method and apparatus of the invention, as applied to an open-end spinning machine, is shown.
Figures 4A, 4B:
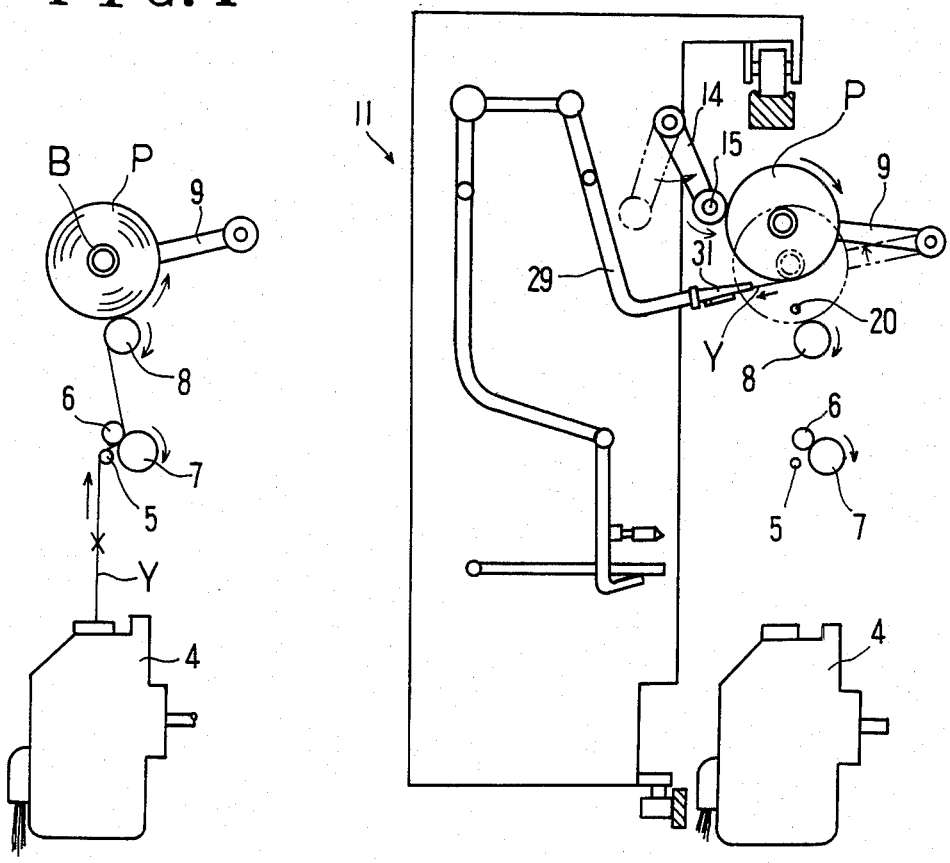
FIG. 4 (*a*) to (*j*) are illustrative side views showing the successive steps in carrying out the yarn-piecing method of the invention, and illustrating apparatus in accordance with the invention.
Figure 4:
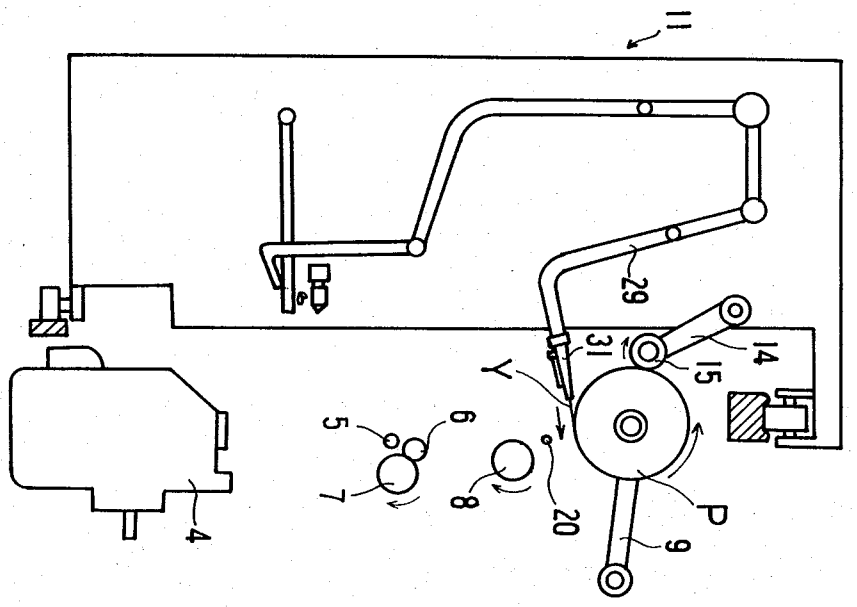
Figure 4:
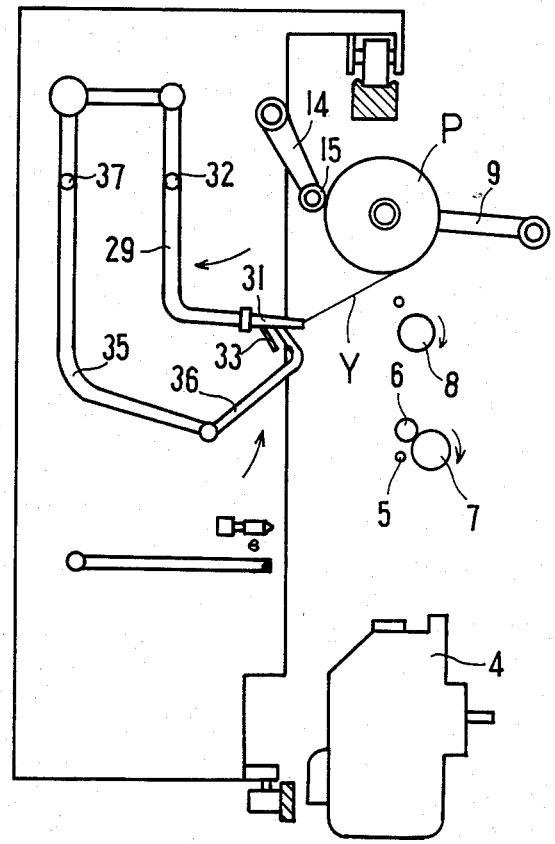
Figure 4:
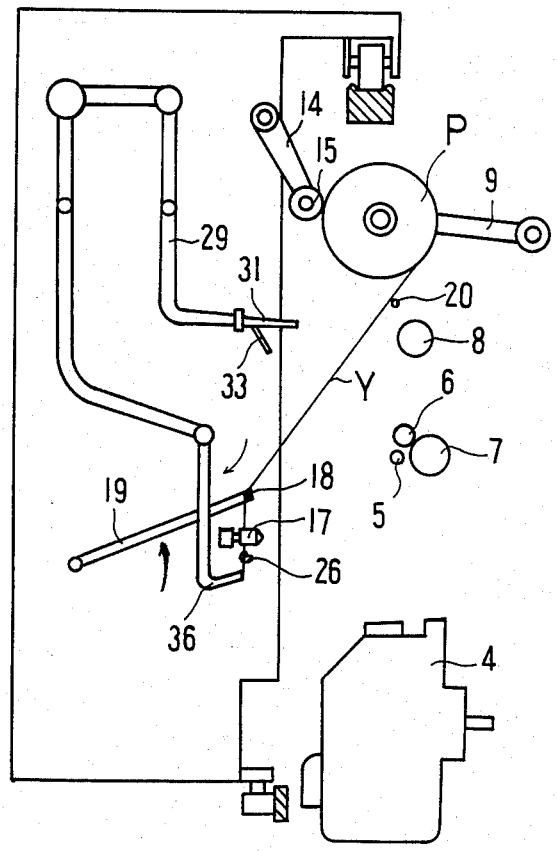
Figure 4:
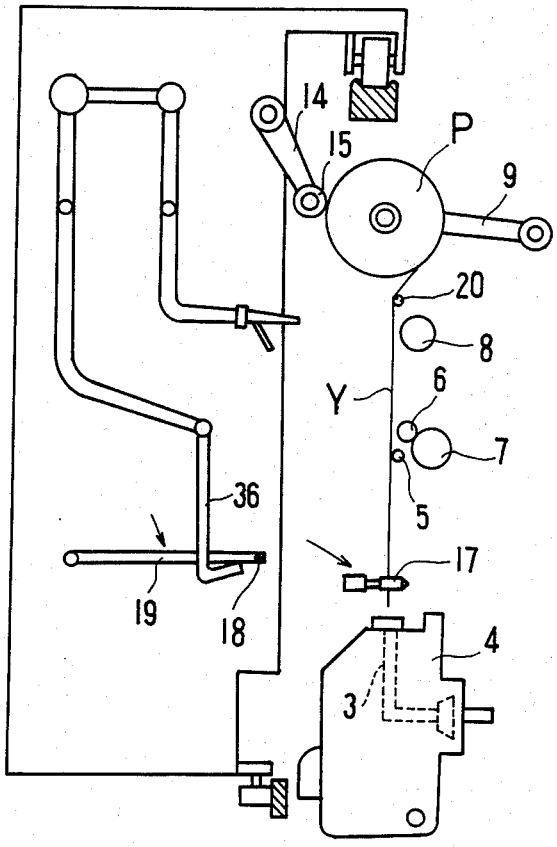
Figure 4:
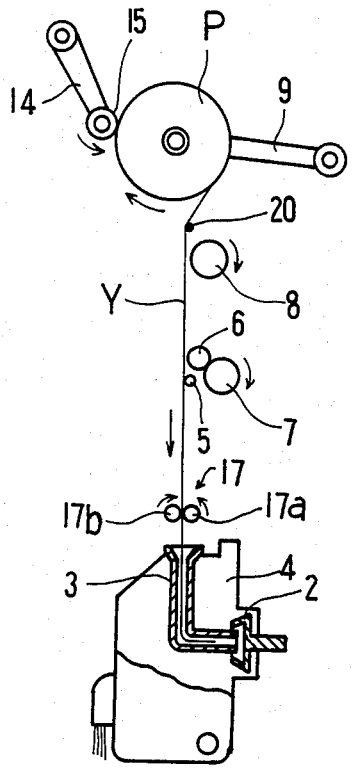
Figure 4:
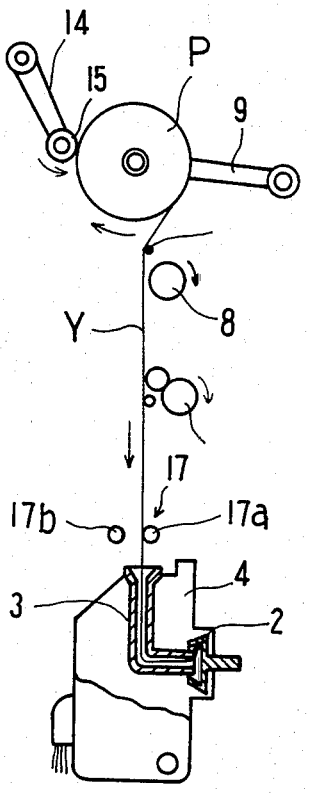
Figure 4:
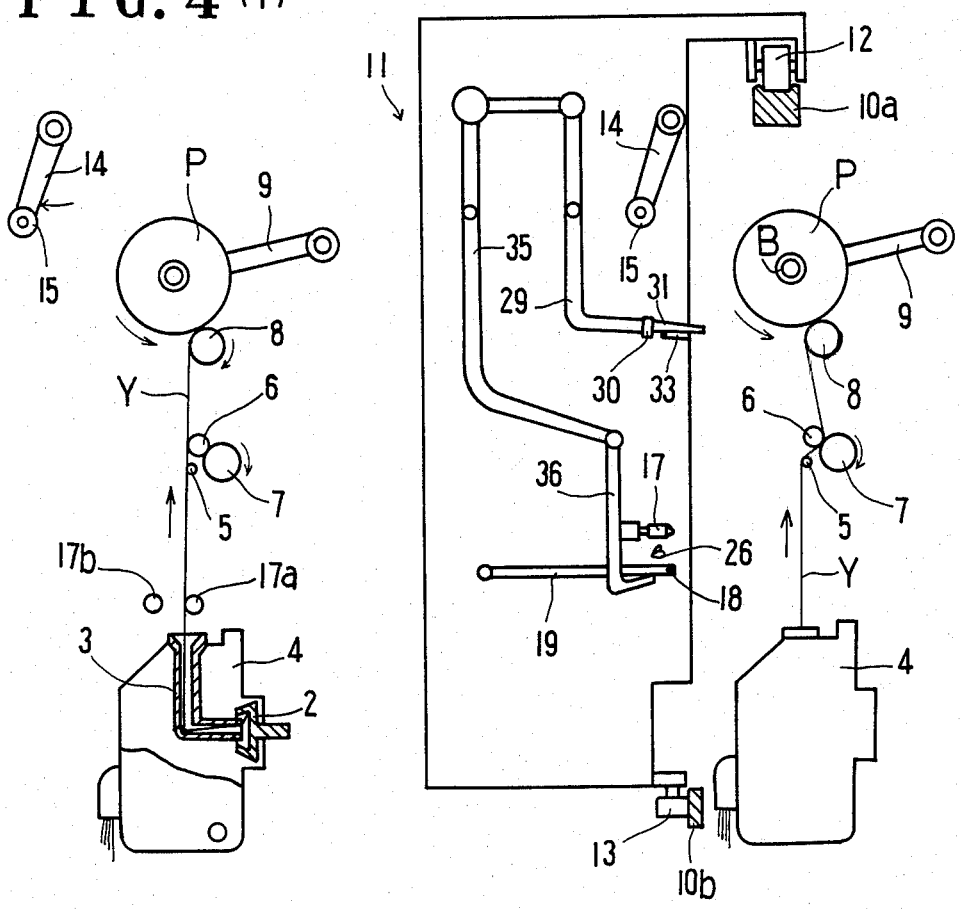

Reference is first had to FIG. 1. As is well known, an open-end spinning machine 1 generally comprises a plurality of spinning units 4, each of which defines a working or spinning station of the machine. Each spinning unit 4 includes a spinning rotor 2 for forming a twisted spun yarn Y from fibers supplied thereto, and a yarn exit tube 3 through which the spun yarn Y is withdrawn from the spinning unit. Referring briefly to FIG. 4 (*j*), along the normal withdrawal path of yarn Y is disposed a yarn winding mechanism which includes a yarn guide 5, a draw-off roller 7 paired with a pressure roller 6, and a traversing drum 8 as a take-up or winding drum for winding up the spun yarn on a bobbin B while distributing the yarn for forming a yarn package P of any desired shape such as a cone. The bobbin B is supported by a supporting arm 9 which may be swung up from its normal position by a lifting mechanism (not shown) in the event of a yarn break at that spinning station to such an extent that the exterior surface of the package P will be spaced from the surface of the traversing drum 8 at a predetermined distance regardless of the size or diameter of the package P then formed. In addition, the spinning machine 1 includes top and bottom guide 10*a* and 10*b* extending along the spinning machine, respectively, thereby forming a track for guiding a travelling yarn piecing unit 11.

Referring again to FIG. 1, the yarn piecing unit 11 is supported by said top guide 10*a* in a depending state by way of a roller 12 provided at the top thereof, and travels along the respective spinning units 4 by a driven roller 13 which is disposed at the bottom thereof and kept in an operative contact with said bottom guide 10*b*. When a yarn break takes place at any of the spinning units 4, the piecing unit 11 is automatically moved to that spinning unit calling for repair of the break and stopped there for yarn piecing service. The yarn piecing unit 11 is equipped with a reversible roller 15 which is supported at the free end of a lever 14 and operable by any suitable means such as a pneumatic cylinder (not shown) to swing into a contact with the package P which has been lifted from the traversing take-up drum 8. The reversible roller 15 is driven by a motor (not shown) to rotate the package P in both forward or winding, and reverse or unwinding directions.

Figure 2:
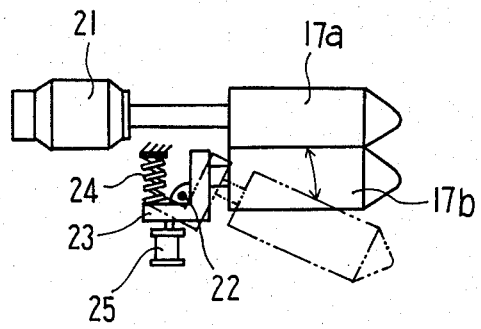
FIG. 2 is a plan view, to an enlarged scale, showing a pair of yarn gripping rollers provided in the yarn piecing unit of FIG. 1.

Yarn control means generally designated by reference numeral 16 includes a pair of yarn gripping rollers 17, a swingable lever 19 having a yarn guide such as a pin 18 at its free end and operated to swing by any convenient means such as a pneumatic cylinder (not shown), and a yarn guide 20 for keeping the yarn clear of the traversing drum 8. Said swingable lever 19 will be used to hold the yarn to be pieced, when it extends from the package P to a second suction nozzle 36, constituting a part of the yarn guide means 27 (which is to be described later), and to displace said yarn so as to pass it between the pair of rollers 17. As detailed in FIG. 2, said pair of gripping rollers 17 includes a driven roller 17*a* which is operatively connected to a drive motor 21 and a pressure roller 17*b* which is rotatably supported by an L-shaped member 23 which is in turn pivotably supported by a pin 22. Said L-shaped member 23 is biased by a compression spring 24 to urge the pressure roller 17*b* against the driven roller 17*a*. The L-shaped member 23 is also swingable to move the pressure roller 17*b* away from its counterpart 17*a* by actuation of an electromagnetic solenoid 25 which is operated against the biasing action of the spring 24. These rollers 17*a*, 17*b* are carried by a moveable bracket (not shown) which may be moved by any suitable means such as a pneumatic cylinder (not shown), to shift the location of the rollers between a first position shown by solid lines in FIG. 1 (or a position which is out of the way of the yarn path during normal operation of the open-end spinning unit 4) and a second position shown by phantom lines in the same figure (or a position which is in the way of the yarn path during normal operation of the spinning unit).

As seen in FIG. 1, below said pair of gripping rollers 17 is disposed a yarn cutting means 26 of any known type for cutting off the free end of the broken yarn, as will be described.

Figure 3:
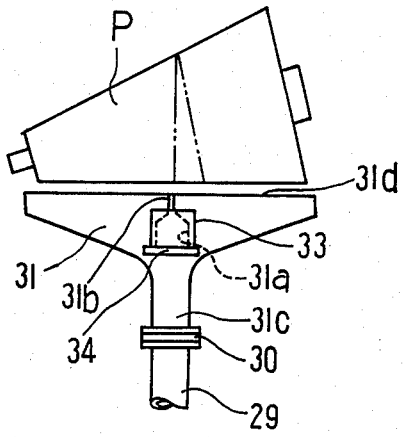
FIG. 3 is also a plan view, to an enlarged scale, but showing a first suction nozzle provided in the yarn-piecing unit.

As shown in FIG. 1, the yarn piecing unit 11 is further equipped with yarn guide means 27 for searching for, and retrieving a broken yarn end from the package P, and then bringing the yarn end just below said yarn cutting means 26. This guide means 27 includes a first suction tube 29 connected to a vacuum source 28 and swingable by any suitable means such a pneumatic cylinder (not shown) towards and away from the package P and having a first suction nozzle 31, connected thereto by way of a vent-type filter 30 and which is positionable close to the package for searching and holding the yarn end. Within the length of said first suction tube 29 is disposed a first valve 32 for shutting off the suction in the tube 29. As shown in FIG. 3, the first suction nozzle 31 is provided with an elongated suction end 31*d* having a width substantially corresponding to the widthwise dimension of the package P, and having a cutout or an opening 31*a* formed on its underside substantially at the center of the wide suction end 31*d* thereof, and a slit 31*b* extending from said opening 31*a* and opening through the end edge of the nozzle. In addition, a cover plate 33 is provided, which is pivotable about a shaft 34, for opening and closing said cutout or opening 31*a*. The motion of this cover plate 33 is so controlled by a cam-type opening mechanism (not shown) that the opening 31*a* is opened when the first suction nozzle 31 is placed in its stand-by position shown by solid lines in FIG. 1, but is closed when the nozzle 31 is placed in its operating position shown by phantom lines in the same figure.

Said yarn guide means 27 further includes an L-shaped second suction tube 35 which is in fixed position and connected to the aforesaid vacuum source 28, and a similarly L-shaped second suction nozzle 36 which is swingably supported at the end of said second suction tube 35, as shown in FIG. 1. The second suction nozzle 36 is adapted to take the yarn end from the first suction nozzle 31, through its opening 31*a*, and carry it to a location just below the yarn cutting means 26, as shown. Like the first suction tube 31, the second tube 35 has a built-in valve 37 for shutting off the vacuum therein.

The steps of the yarn piecing method which uses the yarn piecing unit 11 thus constructed will now be described with reference to the accompanying drawings, particularly FIG. 4 (*a*) to (*j*).

Reference is first made to FIG. 4(*a*) which shows the normal passage of yarn Y as it is spun out from the spinning unit 4. The strand of yarn Y drawn out from the spinning unit 4 is passed, via the yarn guide 5, between the draw-off roller 7 and its paired pressure roller 6, and is then wound up on the bobbin B into a package P while being distributed laterally and reciprocally thereon by the traversing drum 8. If the yarn Y is broken for any reason, for example at a point designated by X in FIG. 4(*a*), the yarn break is sensed by a yarn detector (not shown) of any known design and a yarn-break signal is transmitted, accordingly, to the travelling yarn piecing unit 11. The piecing unit 11 is brought to the spinning unit 4 which has called for piecing of the break, and is stopped in front of that spinning unit, as shown in FIG. 4(*b*).

When a package lifting mechanism (not shown) is actuated by the yarn-break signal, the package supporting arm 9 is swung upwardly, as illustrated in FIG. 4(*b*), to lift the package P off the traversing drum 8 to the position shown by solid lines in FIG. 4(*b*). Substantially simultaneously, the lever 14 on the piecing unit 11 is moved to swing, as indicated by the arrow, so that the reversible roller 15 disposed at the end thereof is pressed against the package P to drive the same in the reverse or unwinding direction. Immediately thereafter, the first suction tube 29 and its nozzle 31 is swung towards the package P so that the nozzle 31 is positioned adjacent to the package, whereupon the free end of the broken yarn on the package is located and held by vacuum applied through the first suction nozzle 31.

After the yarn Y is unwound from the package P for a predetermined length by continuing the rotation of the roller 15 in the unwinding direction and guiding the withdrawn yarn length within the first suction nozzle 31, the roller 15 is then rotated in the forward or winding direction as indicated by arrows in FIG. 4(*c*) to again wind up a predetermined portion of the unwound yarn onto the package P. Since the yarn Y unwound from the package and drawn into the first suction nozzle 31 in the previous step is restricted by, and is therefore positioned within the narrowed base portion 31*c* of the nozzle (see FIG. 3), the yarn may be rewound on the package P at only one position thereon, corresponding to the location of said narrowed base portion 31*c*, or rewound substantially at the center of the package.

The length of broken yarn which is initially unwound from the yarn package P, and the portion of that initially unwound length which is then rewound at a single location on the package, are determined by preselected numbers of revolutions of the roller 15 which engages the package P and whose circumference is known. Of course, the yarn was traversed back and forth along the package width as it was wound during the normal spinning operation and therefore will be similarly traversing the package as it is being unwound, so that the actual length of yarn which is unwound is only generally, but not precisely finite. However, because it is then rewound at a single location on the package, the length portion which is rewound is fairly precisely equal to the circumference multiplied by the number of revolutions of the roller 15 during the rewinding steps of the process. Considering the relevant machine dimensions between the yarn package and the spinning unit, under usual circumstances the initially withdrawn length of yarn should be equal to about 12 circumferences, or 12 revolutions of the roller 15. Regarding the length portion which will be rewound on the package, only a length equal to that which will be again unwound as the yarn is brought to the yarn cutter (as will be described) plus that additional length which will be unwound when the yarn is reintroduced into the spinning unit and drawn into the spinning chamber, must be rewound. This shorter, rewound length will differ depending upon which of the embodiments of the invention, to be described, is used. In any event, the desired number of revolutions of roller 15 may be easily controlled using a conventional timer (not shown).

When said part of the yarn has been rewound on the package P, the first suction tube 29 with the nozzle 31 is returned to its original, stand-by position as shown in FIG. 4(*d*), with the remaining portion of the yarn therein, whereupon the cover plate 33 is opened. Then, the second suction nozzle 36 is rotated upwardly until its suction end enters the first suction nozzle 31 through its opening 33, as shown in FIG. 4(*d*). Simultaneously with this action of the second suction nozzle 36, the first valve 32 is closed to shut off the suction in the first suction nozzle 31, and the yarn end held therein by such suction is then taken over and held by the second suction nozzle 36. Subsequently, the second suction nozzle 36 is swung downwardly, thereby to extend the yarn Y from the package P to a position below the yarn cutting means 26, as seen in FIG. 4(*e*).

The lever 19 is then swung upwardly and, while its end is still held by suction in nozzle 36, the yarn Y is engaged and moved by the guide pin 18 at the end of the lever to a position where it is nipped by and between the now idle rollers 17, as shown in FIG. 4(*e*). The yarn is then cut by cutting means 26, so that a definite length of yarn, as measured from the package P to the cutter 26, is obtained.

The cutter 26 is a conventional solenoid-operated, scissor-type cutter. It should also be noted that, as the yarn is introduced between the rollers 17, they are in their open position as shown by dotted lines in FIG. 2, after which the rollers 17*a*, 17*b* are brought together as indicated by the full-line showing in FIG. 2. Alternatively, the rollers 17 may be rotating in their closed position, in direction tending to draw the yarn downwardly, as the yarn is moved by the lever 19 therebetween. In that case the yarn is nipped by the tapered ends of the rollers 17 (FIG. 2) and thereby drawn between the cutting operation. After such yarn end cutting, the second valve 37 in the second suction tube 35 is closed to shut off the suction in the nozzle 36.

The lever 19 is then rotated downwardly to its stand-by position, whereupon the rollers 17 are shifted from their position shown in FIG. 4(*e*) to their position shown in FIG. 4(*f*) which is within the yarn path during normal operation of the open-end spinning unit 4, thus placing the cut yarn end just above the exit port of the yarn draw-off tube 3 of the spinning unit, as clearly seen in FIG. 4(*f*). At this time, the yarn guide 20 keeps the yarn Y clear of the traversing drum 8.

To introduce the cut yarn end into the draw-off tube 3 of the spinning unit 4, the reversible roller 15 and the yarn nip rollers 17 (the latter rollers 17 being shown in FIG. 4(*g*) through 4(*i*) in 90°-displaced position for ease of understanding) are driven, as indicated by arrows in FIG. 4(*g*), in a direction which causes the yarn to be unwound from the package P and into the draw-off tubes. The yarn end is moved through the draw-off tube 3, and towards the spinning rotor 2 under the influence of the normal vacuum which is created within the spinning chamber of the rotor. When a given predetermined position within the draw-off tube 3 is reached by the yarn end, the roller 17*b* of the pair is separated from its counterpart pressure roller 17*a* as shown in FIG. 4(*h*), while the roller 15 continues to rotate only for a definite length of time, which determines a predetermined distance, and is then stopped. The yarn end is moved further towards the rotor 2 by the action of the vacuum therein until it reaches the deposit of fibers which are then introduced and collected in the form of a ring on the fiber collecting surface of the rotor 2, whereupon the yarn end thus inserted is connected or pieced-up with the fibers on said collecting surface, as is well known.

Referring to FIG. 4(*i*), the reversible roller 15 is then swung away from the package P and the lifting mechanism for the supporting arm 9 is turned off to again bring the package into operative contact with the traversing drum 8 for driving the same in normal forward direction to begin drawing and winding up of the pieced-up yarn thereon. Thereafter, the spun yarn Y coming out from the spinning unit 4 is placed in engagement between the draw-off roller 7 and the pressure roller 6, either manually, or by use of any suitable means such as a yarn threading mechanism (not shown), and the rollers 17 are returned to their original stand-by position, as shown in FIG. 4(*j*). Thus, the spinning unit 4 resumes its normal spinning operation.

It will therefore be understood that in accordance with the invention, a length of the yarn is unwound, and then rewound at one predetermined position on the yarn package before feeding the yarn end into the spinning unit 4 for piecing-up the yarn, whereupon the yarn is again unwound from that single location on the package without being traversed along the package periphery, so that an accurate length of yarn as is necessary for successful yarn piecing is unwound and inserted into the spinning unit 4, with the result that the yarn piecing-up operation may be accomplished with much improved uniformity and reliability.

Figure 5:
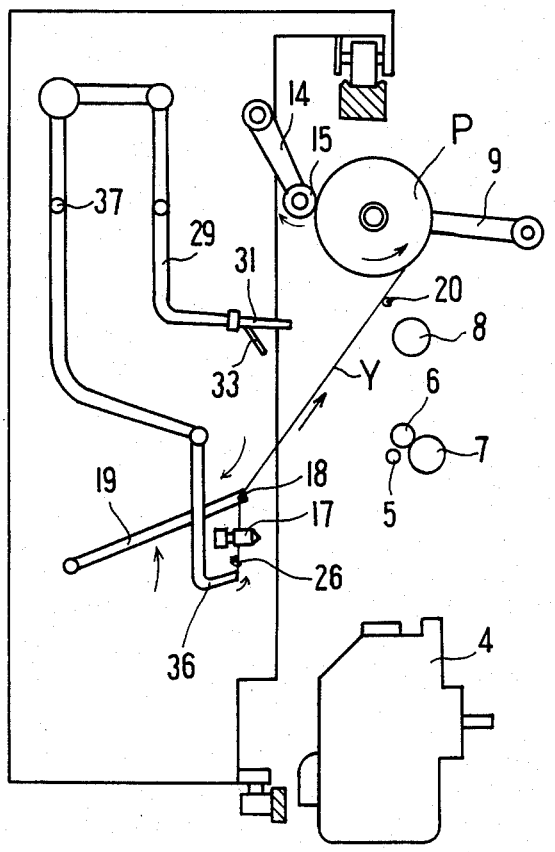
FIG. 5 is a side view of a modified embodiment of the invention.

Yarn piecing in accordance with the invention has been described with reference to a preferred embodiment thereof, but it may be carried out using other modified embodiments, as follows:

Instead of rewinding the portion of the yarn on the package P while the yarn is within the first suction nozzle 31 as illustrated in FIG. 4(*c*), this step of rewinding may be carried out after the unwound yarn is held by the second suction nozzle 36 but before cutting the yarn end, as shown by the arrows in FIG. 5. In such embodiment, it is desirable that the yarn guide 20, over which the rewinding yarn will move, be provided with a yarn-centering means, such as a centrally grooved shape, for preventing the yarn from making a traversing pattern of motion on the package during rewinding thereof. The rewinding is done by the roller 15 driven in the forward direction, as shown in FIG. 5, and it will be understood that the rollers 17, between which the yarn is passing, are idling at this time. Moreover, the suction within the nozzle 36 is temporarily discontinued by closing the valve 37. After rewinding, the valve 37 is reopened, to hold the remaining yarn portion within the nozzle 36, by suction, during operation of the cutter 26 which then cuts the yarn to predetermined length.

Figure 6:
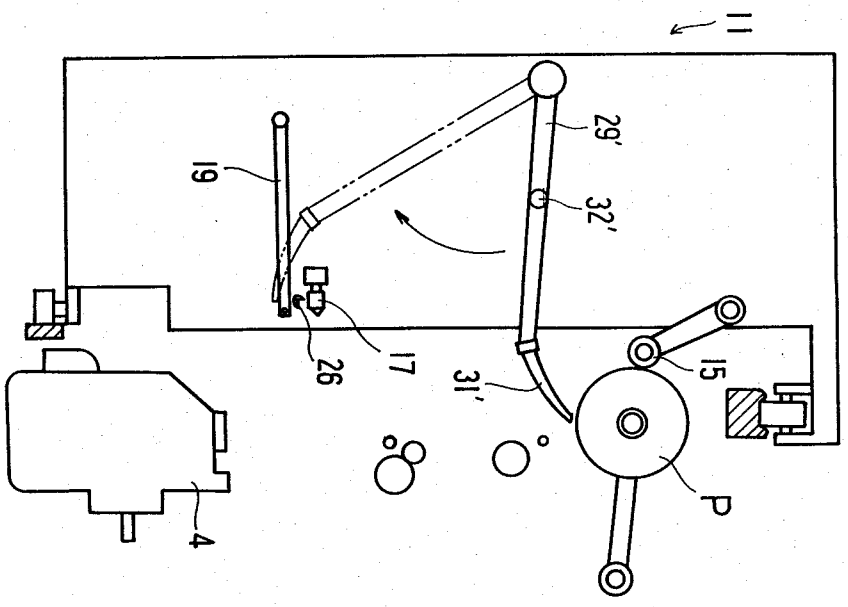
FIG. 6 is a side view of another modified embodiment of the invention.

Referring to FIG. 6 which illustrates still another modified embodiment of the invention, the yarn piecing unit 11 may employ only one suction tube 29' having a suction nozzle 31', rather than the first and second suction nozzles 31 and 36, so that transferring of the yarn from the first suction nozzle to the second suction nozzle may be dispensed with.

That is, by reverse rotation of the roller 15 a length of yarn is unwound from the package P and drawn into the suction nozzle 31' when it is in its full-line position, as seen in FIG. 6. The roller 15 is then rotated in direction to rewind a portion of the unwound length back on to the package P, but at a single location thereon. The yarn may be rewound either before or after the tube 29', which carries the nozzle 31', is swung downwardly to its second position as shown by dotted lines in FIG. 6. Thus, an unwound length of the broken yarn is brought to a position below the cutter 26, at which it may be moved between the rollers 17 to be held for the cutting operation, upon rotation of the lever 19 as explained in connection with the previous embodiment. Transferring of the yarn between two suction nozzles, as in the first embodiment, is thereby avoided. The vacuum valve 32' is opened only while drawing the yarn from the package P and holding it during the operation.

Figure 7:
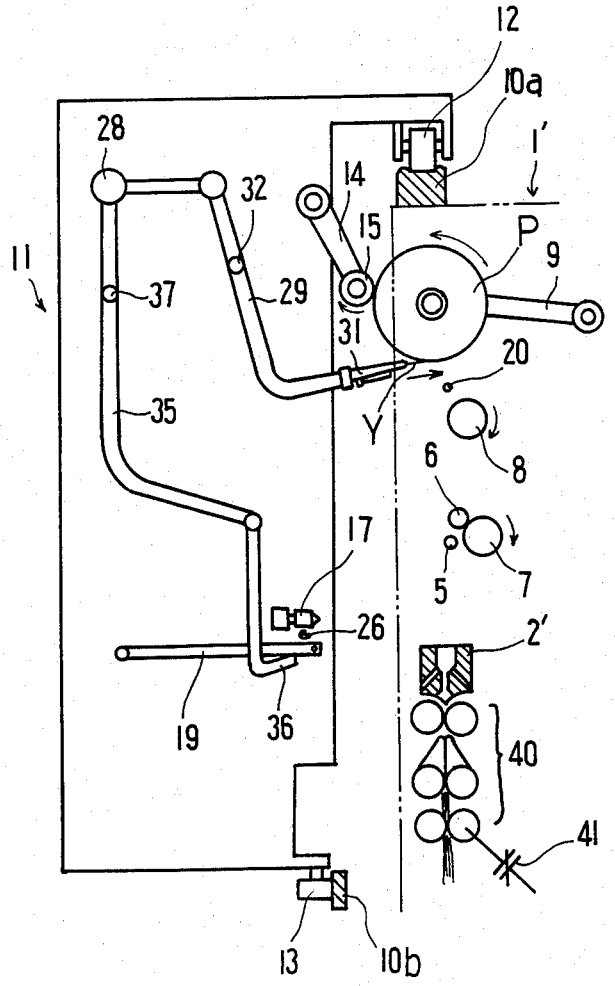
FIG. 7 is a side view showing an embodiment of the invention as applied to an air-jet spinning machine for producing a so-called fasciated yarn.

While the invention has been illustrated and described so far with reference to various embodiments thereof as applied to an open-end spinning machine 1, it is also applicable to other pneumatically-operated ringless spinning machines such as an air-jet spinning machine 1' as illustrated diagramatically in FIG. 7 for forming a so-called fasciated yarn.

The air-jet spinning frame 1' of FIG. 7 comprises three pairs of rollers constituting a fiber drafting mechanism for drafting sliver or roving into a fleece of fibers, and a false-twisting nozzle 2' which receives the fleece of fibers and forms a spun yarn from said fleece by placing the fibers under the action of a rotary stream of air generated therein. Reference numeral 41 designates a clutch for engaging and disengaging the first pair of drafting rollers. The yarn winding mechanism in the spinning frame 1' and the yarn piecing unit 11 may be substantially as described in any of the previously described embodiments with reference to an open-end spinning machine 1, although FIG. 7 illustrates an arrangement corresponding to that of FIGS. 1–4. Therefore, the same reference numerals are used to designate like parts.

In the piecing-up operation on this air-jet spinning frame 1', the package P is rotated in the reverse direction by the reversible roller 15 to first unwind the yarn end from the package when the first suction tube 29 and first suction nozzle 31 have been swung toward the package P. The first suction nozzle 31 having its end placed adjacent to the package P locates and holds the broken yarn end by suction as it is withdrawn from the package. After a given length of yarn is unwound from the package P by the reversible roller 15 into the first suction nozzle 31, the roller 15 is rotated in the forward direction to again wind up only a part of the unwound yarn at a single location on the package. As stated earlier, because the yarn previously unwound from the package P into the first suction nozzle 31 is positioned within the centrally located narrowed base portion 31c of the first suction nozzle, the yarn is taken up in rewinding at only that given position on the package P corresponding to said narrowed base portion 31c.

The end of the yarn thus rewound is then brought by the second nozzle 36 to below the yarn cutting means 26; is moved by the arm 19 and its end is into engagement with rollers 17; is then held by the rollers 17 while it is cut by the yarn cutting means 26, as described in connection with FIG. 4 (*a*)–(*j*). The cut end of the yarn is introduced into the now inactive false-twisting nozzle 2' by rotation of the rollers 17 and roller 15, after which it is connected to the fleece of fibers fed through the drafting mechanism 40 by engaging the feed clutch 41, which sets the mechanism 40 in operation. Thus, yarn piecing is accomplished and newly spun yarn is formed. The operations thereafter are the same as those which are performed in yarn piecing method applied to an open-end spinning machine 1.

While the invention has been illustrated and described with reference to various specific embodiments thereof, it is to be understood by those skilled in the art that various changes in the details may be made without departing from the spirit and scope of the invention.

What is claimed is:

1. A method of piecing a broken yarn from a yarn package on a rotatably mounted bobbin into a pneumatically operated spinning unit with which the bobbin is associated in a ringless spinning machine, comprising the steps of catching the free end and unwinding a length of said broken yarn from said yarn package, rewinding part of said length on to said yarn package at substantially a single location on the surface thereof whereby a finite length of said broken yarn extending from said location can be determined, cutting said length of broken yarn to provide a cut end thereof and thereby determining said finite length to be that length of said yarn between its said cut end and said location on said yarn package, introducing said cut end of the yarn into said spinning unit while unwinding a further predetermined length of said yarn from said location on said yarn package, and again winding said yarn from said spinning unit on to said yarn package.

2. A method according to claim 1 wherein said yarn package is cone-shaped, and said location thereon is substantially a middle location along the width of said package.

3. A method according to claim 1 wherein, after said rewinding step and before said cutting step, a substantial portion of said rewound yarn is again unwound from said package whereby, after said cutting, said finite length of yarn is substantially equal to the distance between said location on the surface of said yarn package and said spinning unit.

4. A method according to claim 1 wherein said pneumatically operated spinning unit is an open-end spinning unit.

5. A method according to claim 1 wherein said pneumatically operated spinning unit is an air-jet spinning unit for forming fasciated yarn.

6. In a ringless spinning machine having a pneumatically operated spinning unit, a yarn winding drum, a rotatable bobbin spaced away from said spinning unit and disposed for engagement with said winding drum for winding yarn produced by the spinning unit on said bobbin in a yarn package having predetermined width, and means for disengaging said bobbin and said winding drum, the improvement comprising apparatus for piecing a broken yarn from said yarn package into said spinning unit, comprising reversible drive means for engaging and rotating said bobbin in either direction when said bobbin is disengaged from said winding drum, suction means including an elongated suction nozzle having length substantially equal to said width of the yarn package and valve means for selectively applying and releasing suction at said nozzle, means for moving said nozzle between a first position adjacent to said yarn package when said bobbin is disengaged from said winding drum and a second position spaced away from said yarn package and said spinning unit, yarn cutting means at a predetermined location, means including said suction means and said reversible drive means for catching the free end and drawing a length of broken yarn from said yarn package into said nozzle, means for determining a substantially single surface location on said yarn package at which said yarn length will be rewound thereon from said nozzle responsive to actuation of said reversible drive means and said valve means for releasing suction at said nozzle, and means including said suction means and said reversible drive means for again drawing said length of broken yarn from said yarn package at said location thereon and for moving said drawn yarn length to a position adjacent to said cutting means for cutting the same, whereby said length of broken yarn between said cutting means and said surface location on said yarn package is accurately predetermined.

7. The improvement according to claim 6, wherein said means for determining a substantially single surface location on said yarn package at which said yarn length will be rewound thereon from said nozzle comprises a narrow base portion of said nozzle extending transversely of the direction of elongation of said nozzle and disposed substantially midway of said nozzle length for accumulating drawn yarn within and centrally of said nozzle length whereby said rewinding of the yarn from said nozzle on to said package takes place in alignment with said narrow base portion.

8. The improvement according to claim 7, wherein said suction means further comprises a movable suction tube to which said suction nozzle is attached and whereby said nozzle is moved between its said first and second positions, said yarn cutting means being disposed in fixed position substantially adjacent to said second position of said nozzle, and which further comprises means for moving said yarn into said cutting means when said nozzle is in its said second position.

9. The improvement according to claim 7, wherein said suction means further comprises a swingably mounted suction tube to which said suction nozzle is attached and whereby said nozzle is moved between its said first and second positions, a second suction nozzle, and a second swingably mounted suction tube to which said second suction nozzle is attached, said second suction tube having valve means for selectively applying and releasing suction at said second nozzle and being swingable to move said second suction nozzle between first and second positions thereof, said second suction nozzle when in its said first position being in suction communication with the first said suction nozzle when the latter is in its said second position, said yarn cutting means being disposed in fixed position substantially adjacent to said second position of said second suction nozzle, and which further comprises means for moving said yarn into said cutting means when said second suction nozzle is in its said second position.

10. The improvement according to claim 9, wherein the first said suction nozzle has an underside surface having means defining an opening therein for receiving said second suction nozzle when in said suction communication therewith, said opening including open slit means extending substantially transverse to the direction of said nozzle length for passage of yarn therethrough and out of the first said nozzle.

11. The improvement according to claim 10, which further comprises a cover plate mounted on said first suction nozzle underside surface for movement between positions respectively opening and closing said opening, said opening being substantially closed by said cover plate when the first said nozzle is in its said first position, and said cover plate being moved to its said position opening said opening whereby said second suction nozzle may be received therein when the first said nozzle is in its said second position.

* * * * *

UNITED STATES PATENT AND TRADEMARK OFFICE

CERTIFICATE OF CORRECTION

PATENT NO. : 4,494,371

DATED : January 22, 1985

INVENTOR(S) : TAKAYUKI MORITA et al

It is certified that error appears in the above-identified patent and that said Letters Patent is hereby corrected as shown below:

On the title page,

In the list of references cited, Schultz et al Patent No. "3,999,862" should read --3,999,362--.

Column 1, line 25, after "broken", insert --yarn back into the spinning mechanism of the spinning unit,--.

Column 1, line 26, after "forward", delete "yarn back into the spinning mechanism of the spinning unit,".

Signed and Sealed this

*Fourteenth* Day of *May 1985*

[SEAL]

*Attest:*

DONALD J. QUIGG

*Attesting Officer* *Acting Commissioner of Patents and Trademarks*